US010464083B2

(12) United States Patent
Onofrio et al.

(10) Patent No.: US 10,464,083 B2
(45) **Date of Patent: *Nov. 5, 2019**

(54) SPRINKLER ARC ADJUSTMENT MECHANISM

(71) Applicant: The Toro Company, Bloomington, MN (US)

(72) Inventors: Travis L. Onofrio, Whittier, CA (US); Hyok Lee, Corona, CA (US); Ralph E. Faupel, Riverside, CA (US)

(73) Assignee: The Toro Company, Bloomington, MN (US)

( * ) Notice: Subject to any disclaimer, the term of this patent is extended or adjusted under 35 U.S.C. 154(b) by 313 days.

This patent is subject to a terminal disclaimer.

(21) Appl. No.: 15/449,709

(22) Filed: Mar. 3, 2017

(65) Prior Publication Data

US 2017/0189926 A1 Jul. 6, 2017

Related U.S. Application Data

(63) Continuation of application No. 14/460,270, filed on Aug. 14, 2014, now Pat. No. 9,616,437.

(60) Provisional application No. 61/865,897, filed on Aug. 14, 2013.

(51) Int. Cl.

| | |
|---|---|
| ***B05B 3/04*** | (2006.01) |
| ***B05B 3/16*** | (2006.01) |
| ***B05B 12/16*** | (2018.01) |
| ***B05B 3/00*** | (2006.01) |
| *B05B 15/70* | (2018.01) |
| *B05B 15/74* | (2018.01) |

(52) U.S. Cl.

CPC ..... *B05B 3/0454* (2013.01); *B05B 3/007* (2013.01); *B05B 3/0431* (2013.01); *B05B 3/16* (2013.01); *B05B 12/16* (2018.02); *B05B 15/70* (2018.02); *B05B 15/74* (2018.02)

(58) Field of Classification Search

CPC ... B05B 3/0422; B05B 3/0431; B05B 3/0454; B05B 3/16; B05B 15/10

See application file for complete search history.

(56) References Cited

U.S. PATENT DOCUMENTS

| | | | | |
|---|---|---|---|---|
| 4,901,924 | A | 2/1990 | Kah, Jr. | |
| 5,383,600 | A * | 1/1995 | Verbera | B05B 15/70 239/205 |
| 5,685,486 | A | 11/1997 | Spenser | |
| 6,050,502 | A * | 4/2000 | Clark | B05B 3/0431 239/237 |
| 6,695,223 | B2 * | 2/2004 | Beutler | B05B 3/0459 239/201 |
| 6,869,026 | B2 * | 3/2005 | McKenzie | B05B 3/0431 239/237 |
| 7,261,247 | B2 * | 8/2007 | Yeh | B05B 3/0431 239/237 |

(Continued)

OTHER PUBLICATIONS

United Stales Patent and Trademark Office, Notice of Allowance dated Dec. 12, 2016 in U.S. Appl. No. 14/460,270, 7 pages.

(Continued)

*Primary Examiner* — Ryan A Reis
(74) *Attorney, Agent, or Firm* — Inskeep IP Group, Inc.

(57) ABSTRACT

The present invention is directed to a rotor or sprinkler that allows its watering arc to be rotated, increased, or decreased by user-rotation of the sprinkler's rotating nozzle base.

16 Claims, 11 Drawing Sheets

(56) References Cited

U.S. PATENT DOCUMENTS

| | | | | |
|---|---|---|---|---|
| 7,861,948 | B1 * | 1/2011 | Crooks | B05B 3/0431 239/237 |
| 9,156,043 | B2 * | 10/2015 | Walker | B05B 1/326 |
| 9,616,437 | B2 * | 4/2017 | Onofrio | B05B 3/0454 |
| 2004/0050958 | A1 | 3/2004 | McKenzie et al. | |
| 2008/0230628 | A1 | 9/2008 | Alexander | |

OTHER PUBLICATIONS

United Stales Patent and Trademark Office, Final Office Action dated Jul. 22, 2016 in U.S. Appl. No. 14/460,270, 10 pages.
United Stapes Patent and Trademark Office, Office Action dated Feb. 25, 2016 in U.S. Appl. No. 14/460,270, 11 pages.

* cited by examiner

SPRINKLER ARC ADJUSTMENT MECHANISM

RELATED APPLICATIONS

This application is a continuation of U.S. patent application Ser. No. 14/460,270 filed Aug. 14, 2014 entitled Sprinkler Arc Adjustment Mechanism, which claims benefit of U.S. Provisional Application Ser. No. 61/865,897 filed Aug. 14, 2013 entitled Sprinkler Arc Adjustment Mechanism, both of which are hereby incorporated herein by reference in their entireties.

BACKGROUND OF THE INVENTION

Many popular rotors or irrigation sprinklers in the market today require the use of a screwdriver to set the watering arc. For example, some rotors have an arc adjust shaft accessible from a top of the rotor that, when turned, rotates an arc adjust gear keyed to an adjustable stop. The rotors typically have a fixed left stop and an adjustable right stop. Setting the watering arc can be a slow process of repeated screwdriver arc adjustments and arc setting checks before the desired arc setting is achieved. Typically, rotors of this type can be adjusted to spray within a watering arc of about 40° to 350°.

In the previously described designs, a bull gear is keyed to the nozzle base, allowing the nozzle base to be manually rotated, typically referred to as fast-forwarding, to quickly see the arc setting. This can be done both wet (under pressure) and dry. The stop at each edge is felt tactically by the click of the trip arm and the hard stop as the drive gear engages against the direction of fast-forwarding. Rather than fast-forwarding, an alternate method to determine the watering arc is to watch the unit rotate and trip on each side. This is not ideal because rotors do not typically rotate very quickly.

Fast-forwarding must be actuated towards the direction of drive engagement, both wet and dry. Attempting to back-drive the mechanism will likely break gears if a clutch is not present to take the abuse. When the nozzle base is fast-forwarded with the direction of the drive, the trip mechanism ratchets and prevents damage to the gears.

SUMMARY OF THE INVENTION

The present invention is directed to a rotor or sprinkler that allows its watering arc to be rotated, increased, or decreased by user-rotation of the sprinkler's rotating nozzle base.

Specifically, if the nozzle base is rotated in a first direction so as to pass the trip stop on that side, the entire watering arc is rotated to cover a different area of turf around the sprinkler. If the user wishes to increase the angle or size of the watering arc, the nozzle base can be rotated in a second direction, beyond the trip stop. Finally, the watering arc can be reduced by "fast forwarding" the nozzle base in a first direction without tripping the trip stop, then rotating the nozzle base in a second direction.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which.

DESCRIPTION OF EMBODIMENTS

Figure 1A:
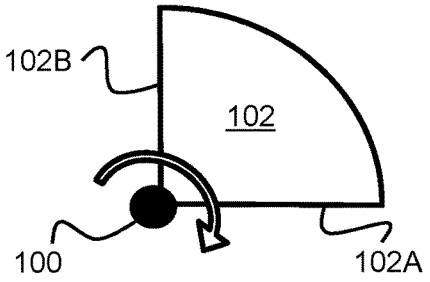
FIGS. 1A and 1B illustrate rotation of a watering arc of a sprinkler.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

In one embodiment, the present invention is directed to a rotor or sprinkler 100 that allows its watering arc 102 to be fully adjusted by user-rotation of the sprinkler's rotating nozzle base 104.

Specifically, if the nozzle base 104 is rotated in a first direction so as to pass the trip stop on that side, the entire watering arc 102 is rotated to cover a different area of turf around the sprinkler 100. However, movement in this first rotational direction maintains the overall angle or arc area of the watering arc 102 between the left edge 102B and right edge 102A. For example, FIG. 1A shows a nozzle base 104 being rotated clockwise beyond the right trip stop, thereby moving the watering arc 102 to the position seen in FIG. 1B.

Figure 2A:
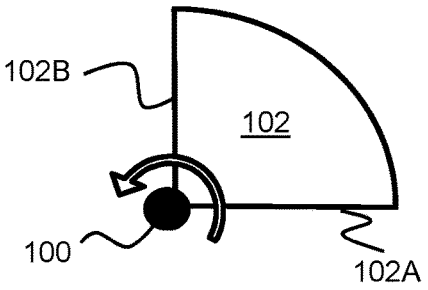
FIGS. 2A and 2B illustrate increasing a size of a watering arc of a sprinkler.
Figure 2B:
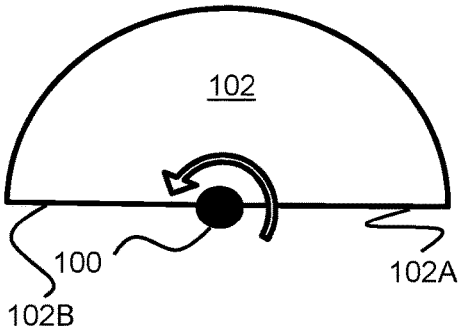

If the user wishes to increase the angle or size of the watering arc 102, the nozzle base 104 can be rotated in a second direction. For example, FIG. 2A shows the nozzle base 104 being rotated in a counter clockwise direction, beyond the left trip stop. Once beyond the left trip stop, the watering arc 102 is increased in size/angle, as shown in FIG. 2B.

Finally, the watering arc 102 can also be reduced in size/angle. For example, in FIG. 3A, the nozzle base 104 is rotated in a counter clockwise direction until just prior to tripping the left trip stop (i.e., the left trip stop is not tripped).

Figure 3A:
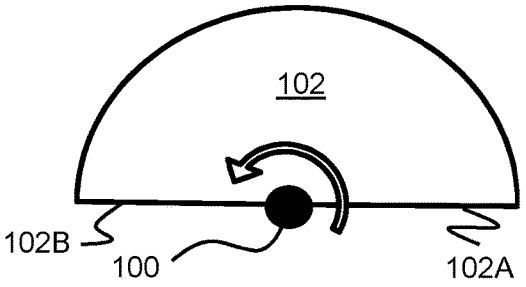
FIGS. 3A and 3B illustrate decreasing a size of a watering arc of a sprinkler.
Figure 3B:
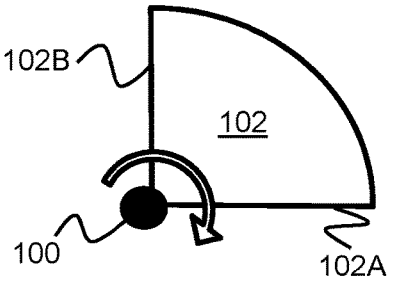

Next, the nozzle base 104 is rotated in the opposite, clockwise direction to decrease the size of the watering arc 102, as seen in FIG. 3B. Since the change in rotational movement by the user occurs prior to the left trip stop, the user may need to perform this action more than once to achieve a desired arc-size reduction.

In this regard, a user can install a sprinkler 100, then immediately rotate or "fast-forward" the nozzle base 104 clockwise (or a first direction) to determine where the "fixed" right edge 102A of the watering arc 102 should be located, then can rotate the nozzle base 104 counter clockwise to determine the left edge 102B of the watering arc 104 is located (i.e., the overall size of the watering arc 102 relative to the right edge 102A).

Figure 4:
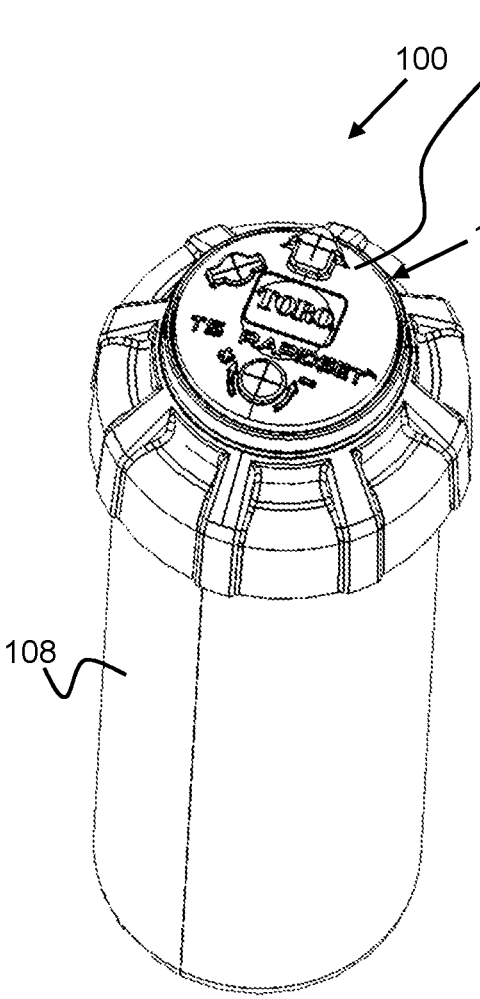
FIG. 4 illustrates an perspective view of a sprinkler according to the present invention.
Figure 5:
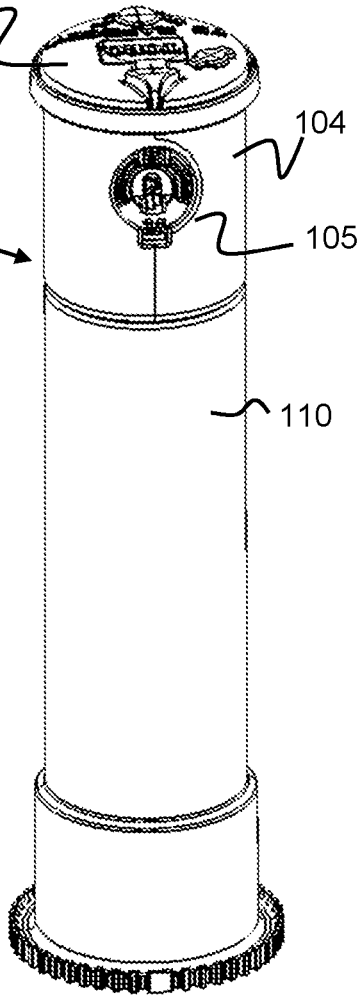
FIG. 5 illustrates a riser portion of the sprinkler of FIG. 4.

FIGS. 4-18 illustrate various aspects and components of one embodiment of a sprinkler 100 that is capable of performing the above-described arc adjustments. FIG. 4 illustrates the sprinkler 100 with a riser portion 106 in a lowered state within an outer body portion 108. FIG. 5 illustrates the riser portion 106 outside of the outer body portion 108, having a nozzle base 104, at top cover 107, a nozzle 105, and a lower, stationary riser body 110. As previously discussed, the riser 106 rises up from the body portion 108 during operation, allowing the nozzle base 104 to rotate on the stationary riser body 110 and expel water through the nozzle 104A.

The nozzle base 104 generally refers to the top housing of the riser portion 106 in which the nozzle 105 is located. While the term nozzle base is used in this specification, this item can also be referred to as a nozzle housing, nozzle enclosure, rotating riser portion, or by other, similar terms.

Figure 9:
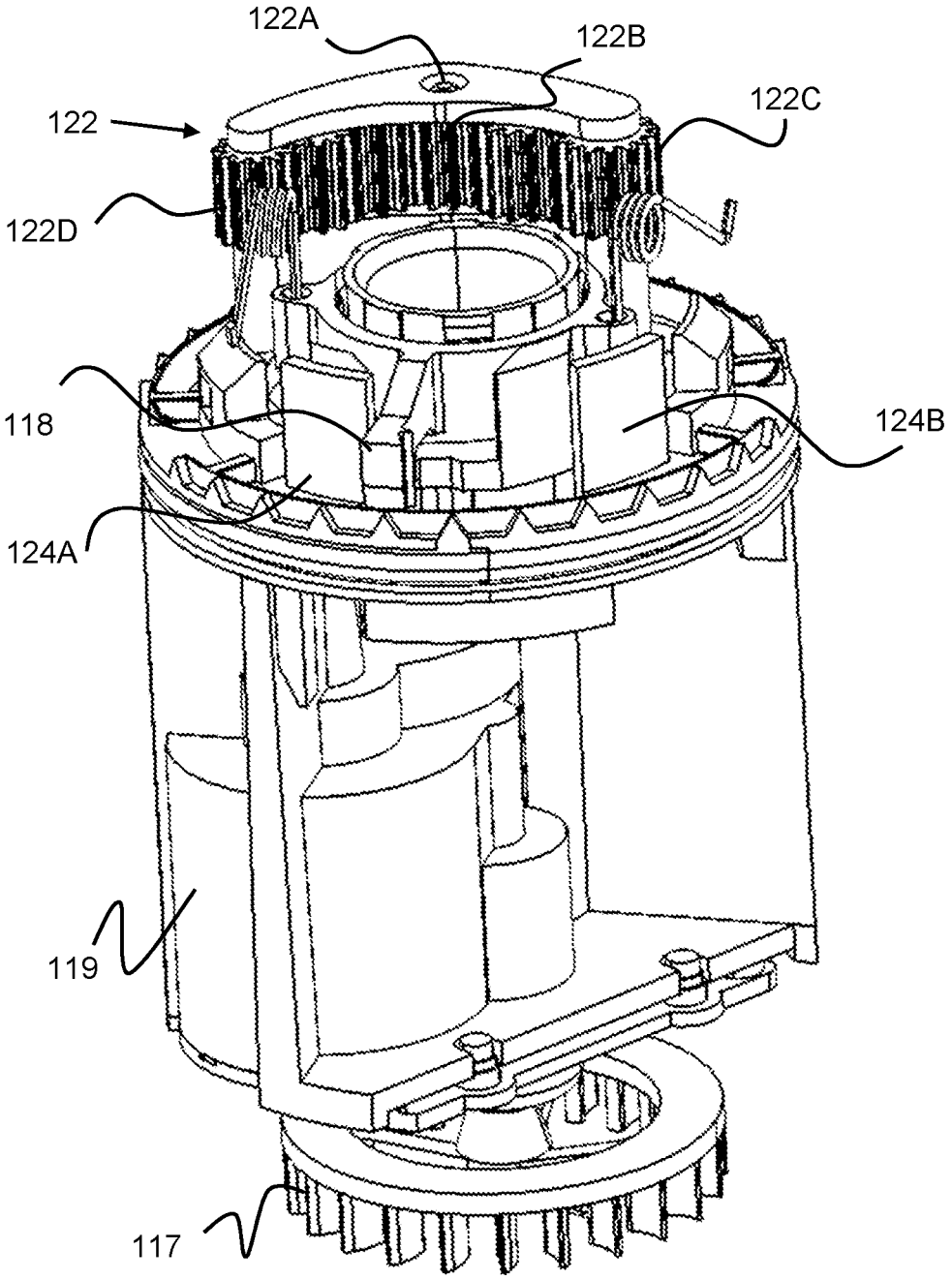
FIG. 9 illustrates a view of a sprinkler gear drive mechanism.

FIG. 9 illustrates a lower portion of the nozzle base rotating mechanism of the present embodiment. As water enters the sprinkler 100, it rotates the turbine 117, which in turn drives reduction gears inside the gear box 119.

Figure 10:
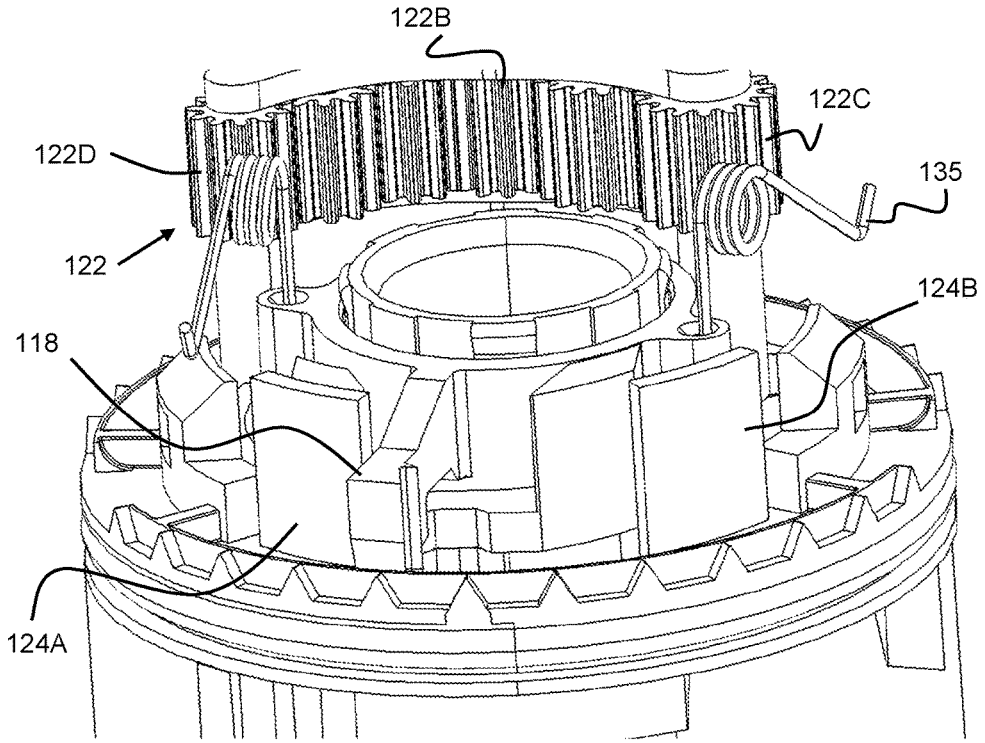
FIG. 10 illustrates another view of the sprinkler gear drive of FIG. 9.
Figure 11:
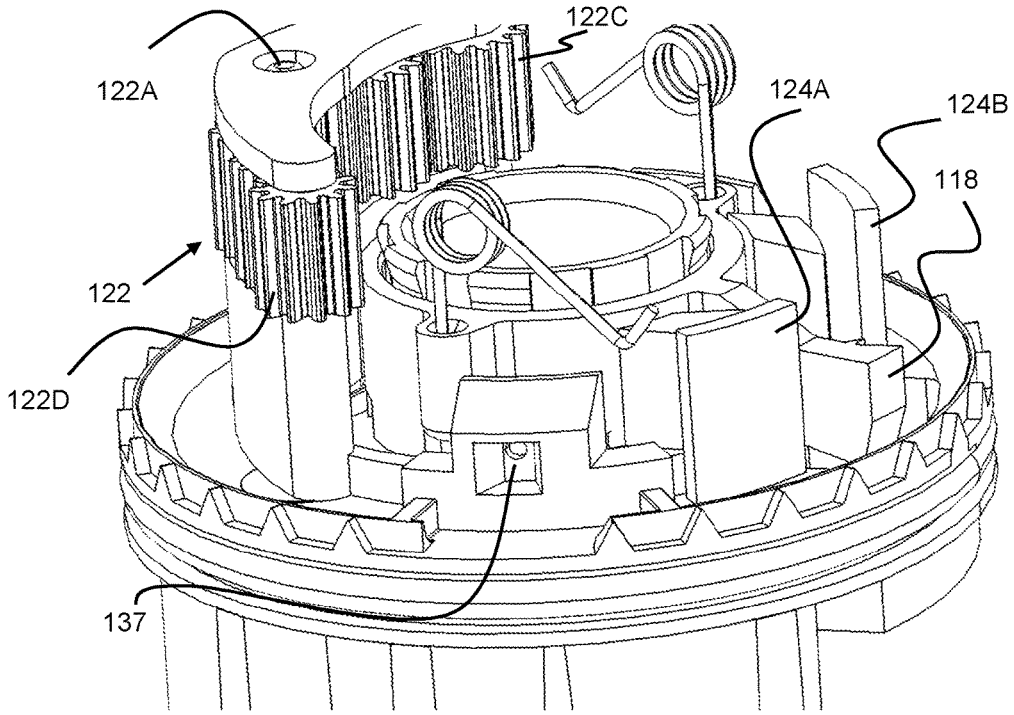
FIG. 11 illustrates another view of the sprinkler gear drive of FIG. 9.

As seen best in FIGS. 9-11, the gear box 119 ultimately drives rotation of a center drive gear 122B of the drive gear assembly 122. Gears of the assembly 122 engaged on one side of the center drive gear 1228 rotate in a first direction, while gears on the opposite side of the center drive gear 1228 rotate in a second, opposite direction. A drive shaft 122A from the gear box 119 drives rotation of the center drive gear 122B and further allows the drive gear assembly 122 to pivot such that either end gear 122C or 122D is moved radially outward, further than the other gears.

The pivot angle of the drive gear assembly 122 is controlled by the trip arm 118. Specifically, the trip arm 118 can be rotated between a right trip stop 124A and a left trip stop 124B. This rotation or movement of the trip arm 118 is assisted by two springs 135 connected to the trip arm 118 and to spring aperture 137 (note: springs are illustrated as being disconnected from apertures 137 for clarity purposes). Portions of the trip arm 118 contact the drive gear assembly 122, such that when the trip arm 118 is in a first position, gear 122D extends radially outwards, and when the trip arm 118 is in a second position, gear 122C extends radially outwards.

Figure 6:
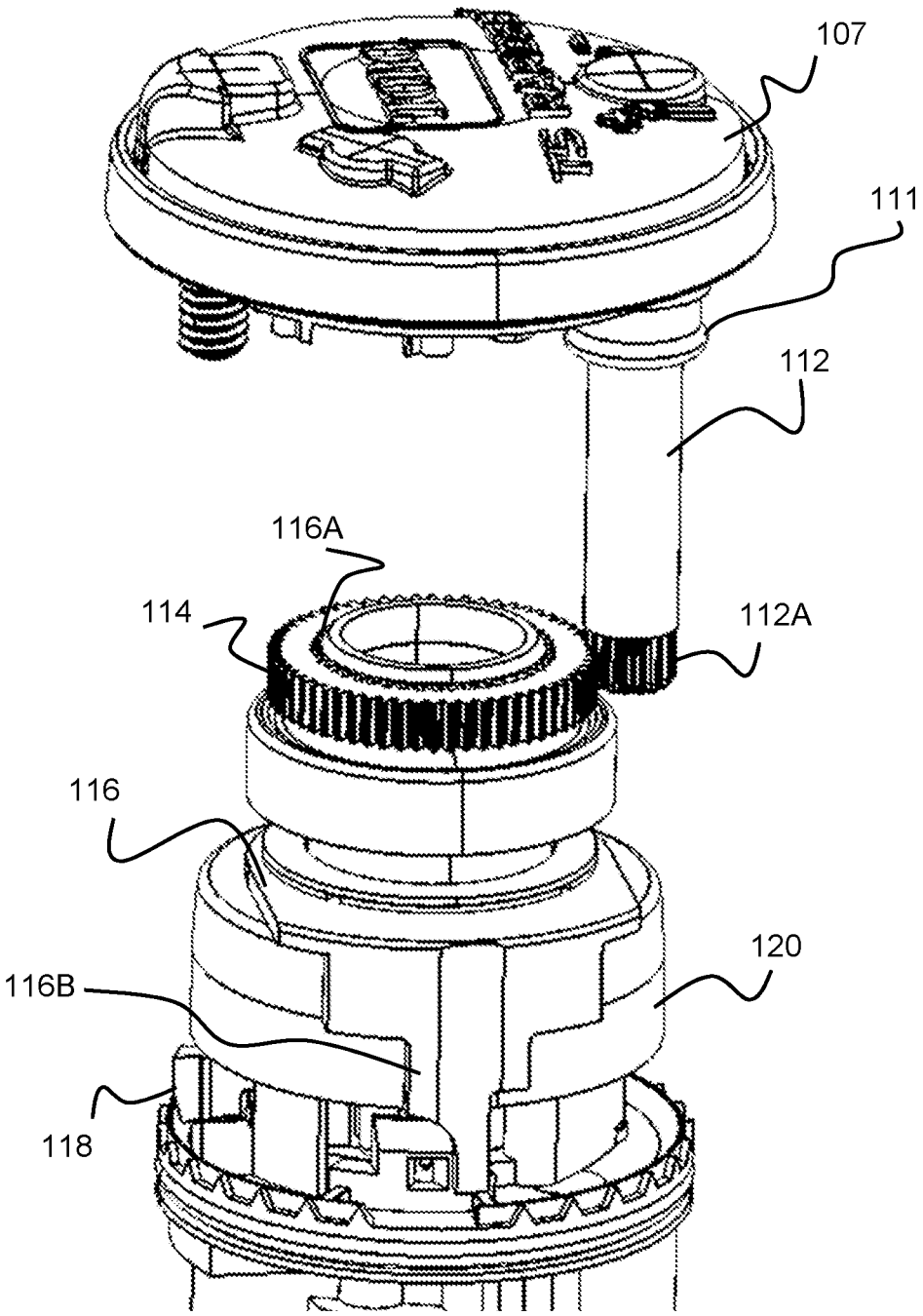
FIG. 6 illustrates a watering arc mechanism within a sprinkler riser.
Figure 7:
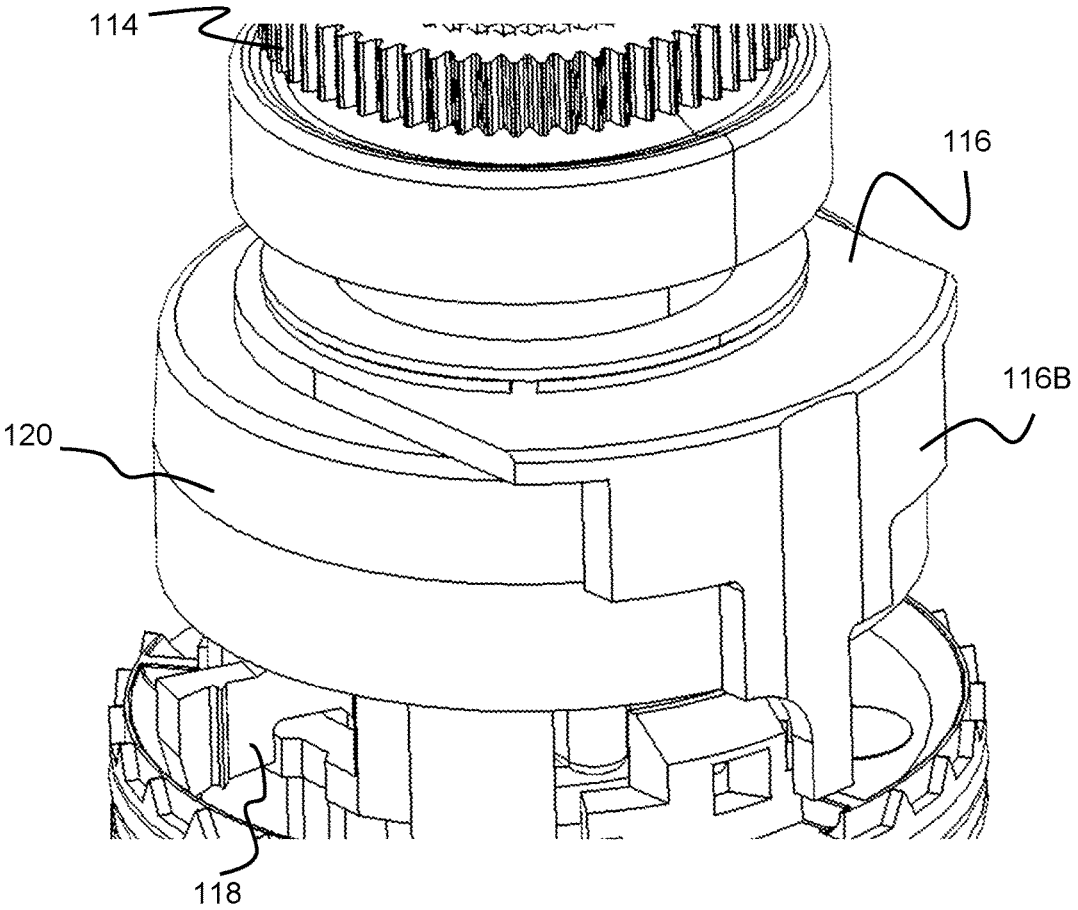
FIG. 7 illustrates another view of the watering arc mechanism of FIG. 6.
Figure 8:
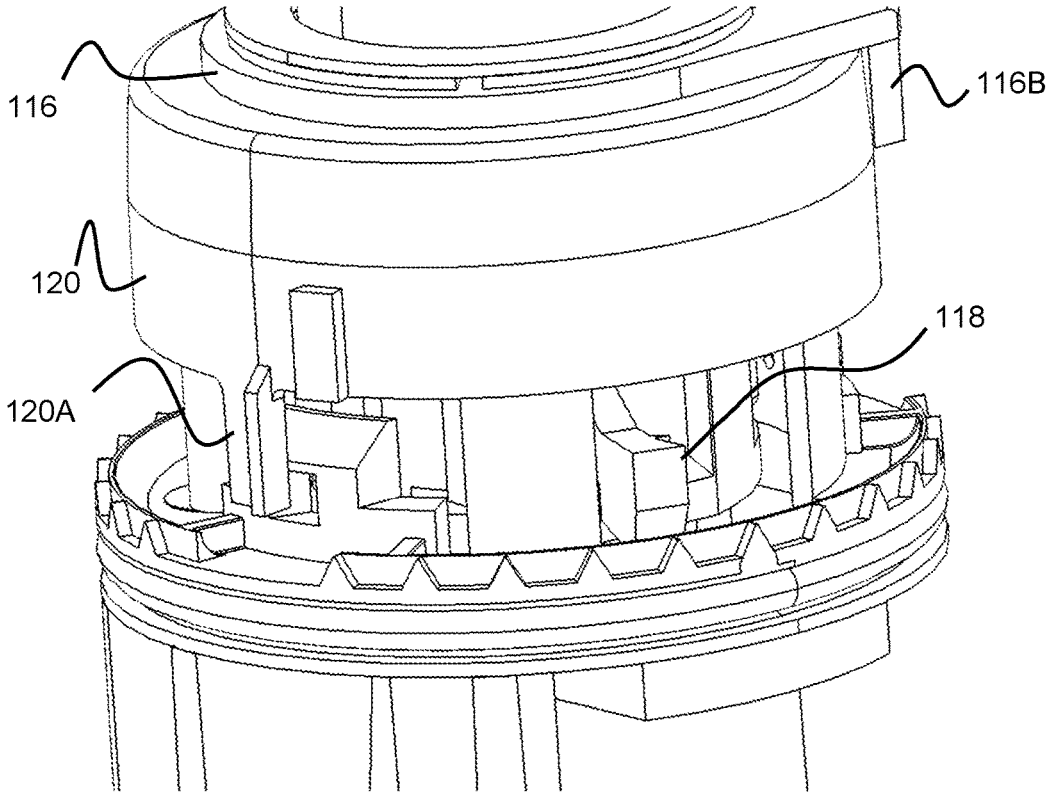
FIG. 8 illustrates another view of the watering arc mechanism of FIG. 6.
Figure 12:
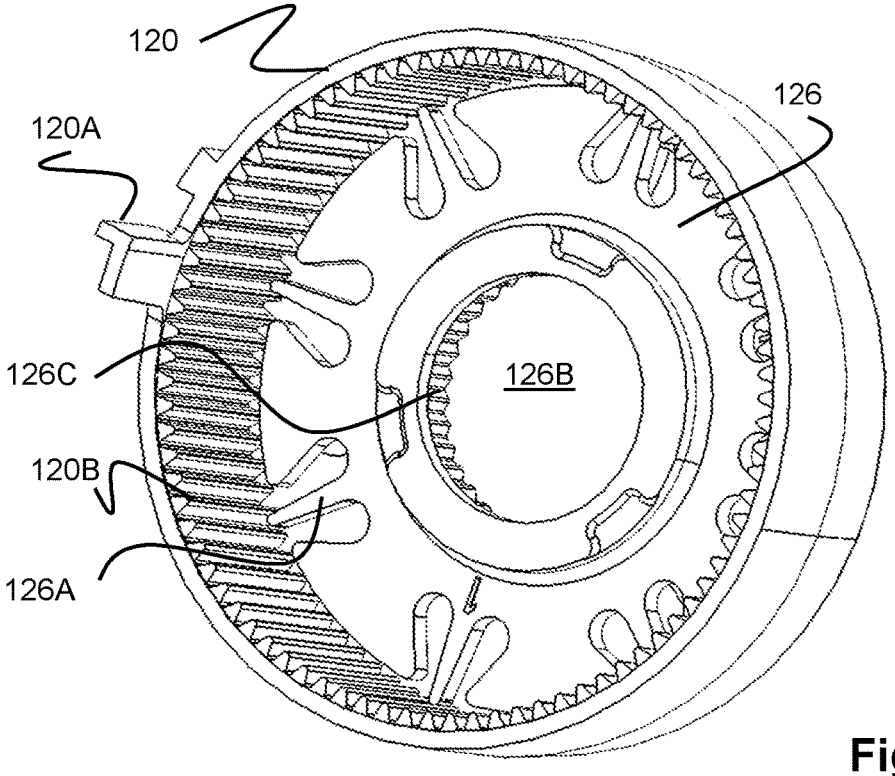
FIGS. 12 and 13 illustrate views of a bull gear and clutch member.
Figure 13:
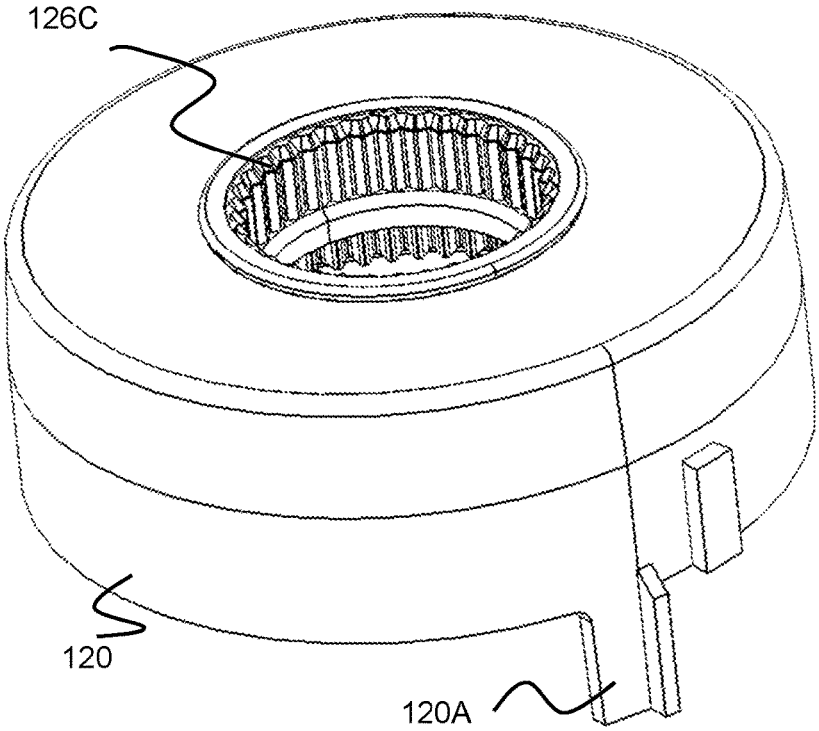

As seen best in FIGS. 6-8, a bull gear 120 is located over the drive gear assembly 122. As seen in FIGS. 12 and 13, the bull gear 120 includes a geared surface 120B along its inner circumference. Hence, depending on the pivotal orientation of the drive gear assembly 122, either gear 122C or 122D will be engaging the geared surface 120B. Since the gears 122C and 122D rotate in opposite directions, they similarly drive the bull gear 118 in different rotational directions, depending on which gear is engaged.

Figure 14:
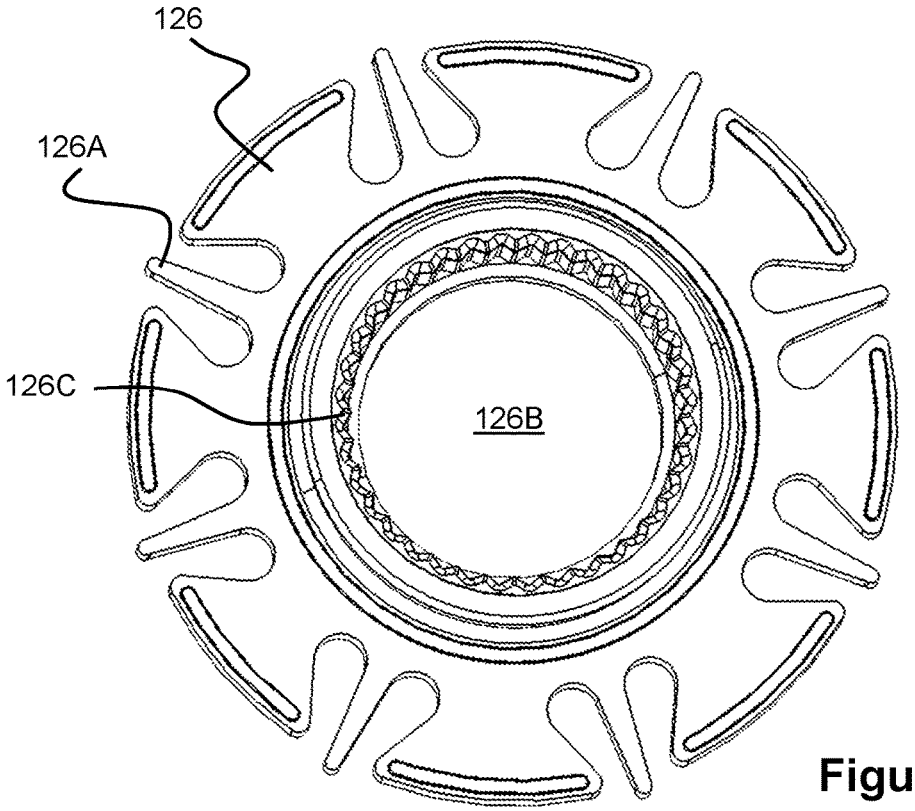
FIGS. 14 and 15 illustrate views of the clutch member of FIG. 12.
Figure 15:
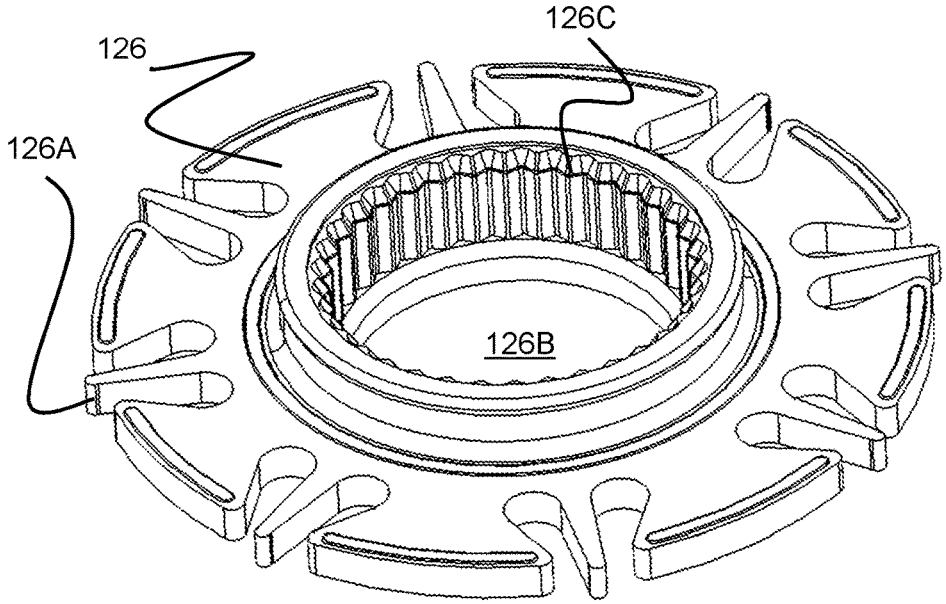
Figure 16:
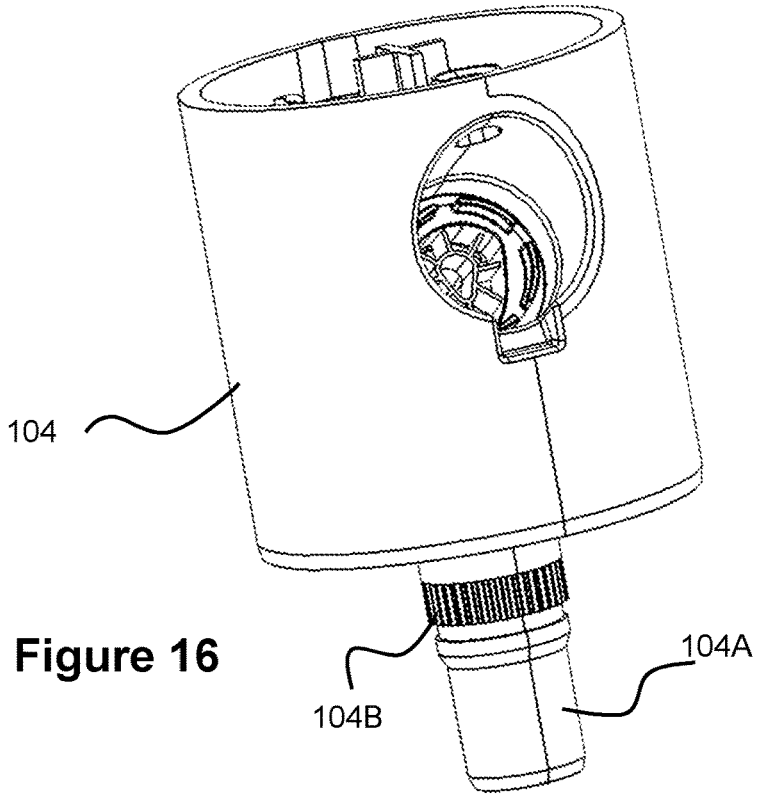
FIGS. 16 and 17 illustrate views of a nozzle base of a sprinkler.
Figure 17:
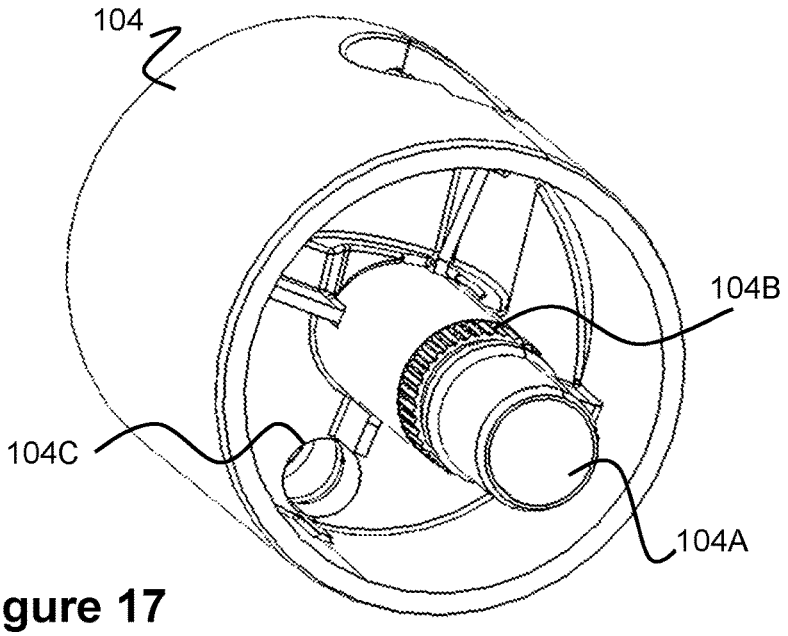

As best seen in FIG. 12, the bull gear 118 includes a clutch member 126 located within it, connecting the bull gear 118 with the nozzle base 104. More specifically, the clutch member includes a plurality of fingers 126A which engage the geared surface 120B of the inner wall of the bull gear 118. As best seen in FIGS. 14 and 15, the clutch member 126 also includes a center aperture 126B with an inner geared wall 126C.

The inner geared wall 126C of the clutch member 126 is located over a tubular portion 104A of the nozzle base 104, engaging the outer geared portion 104B. Hence, as the bull gear 120 rotates, it causes the clutch member 126 to similarly rotate, which in turn rotates the geared portion 104B of the nozzle base 104, resulting in rotational movement of the nozzle base 104 relative to the remaining portions of the sprinkler 100.

Figure 18:
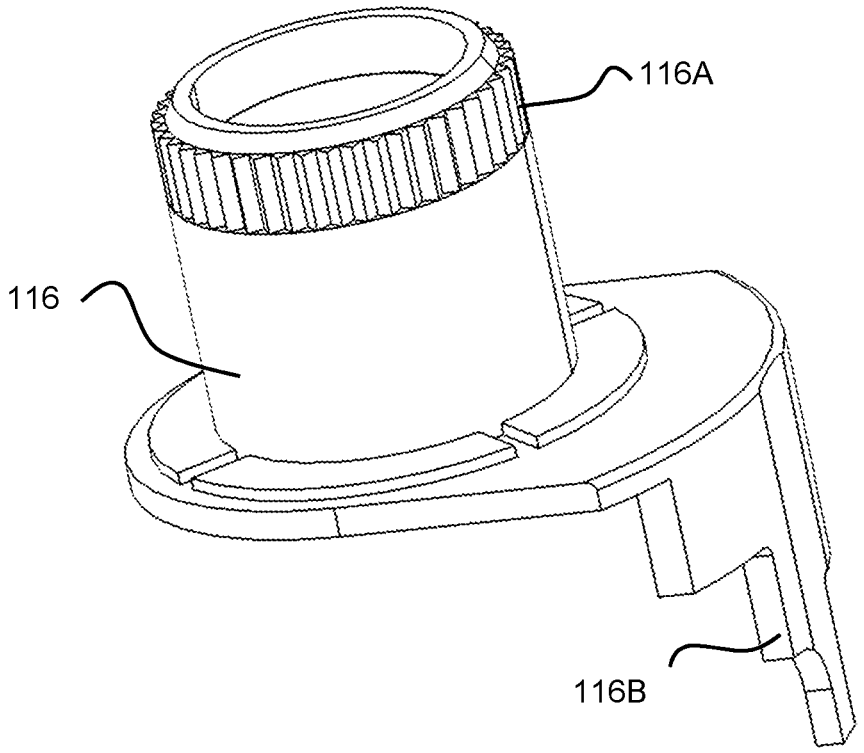
FIG. 18 illustrates an adjustable stop member for a sprinkler.

The trip arm 118 can be moved between its two positions by rotation of a bull gear trip dog 120A located on the bull gear 120 (see FIGS. 8, 12, and 13), and rotation of an adjustable stop trip dog 116B on the adjustable stop member 116 (see FIGS. 6, 7, and 18). These dogs 116B and 120A are tabs or solid members that extend downward into the rotational path of the trip arm 118. In this respect, the arc or angle between these trip dogs 120A and 116B represents the watering arc of the nozzle base 104.

As best seen in FIG. 6, the position of the adjustable stop member 116 can be adjusted in a traditional manner via a tool through the top cover 107. First, the tool rotates adjustment shaft 112. An outer geared region 112A of the adjustment shaft 112 is connected to an outer geared region 116A of the adjustable stop member 116 via engagement with an arc adjustment gear 114. In other words, the arc adjustment gear 114 includes inner and outer geared portions that engage with both region 112A and 116A. Since the adjustable stop member is located on top of the bull gear 120 so as to rotate relative to the bull gear 120 (i.e., the two are not keyed to each other to move in unison), rotation of the adjustment shaft 112 rotates the adjustable stop member 116 (and therefore the adjustable stop dog 116A) relative to the bull gear 120. In this respect, the watering arc of the sprinkler 100 can be increased or decreased with a tool.

Figure 1B:
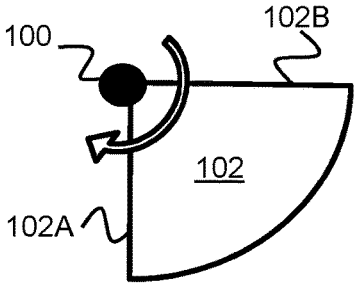

As previously described with regard to FIGS. 1A and 1B, the user can grasp the nozzle base 104 and rotate the nozzle base 104 in a first direction (e.g., clockwise) so as to rotate the entire water arc 102 without increasing its angular size. This functionality is performed by allowing the nozzle base 104 to be rotated while maintaining the positions of both the adjustable stop trip dog 116B and the bull gear trip dog 120A.

Specifically, as the user rotates the nozzle base 104 clockwise, the adjustable stop trip dog 116B contacts the trip arm 118 and therefore is unable to be rotated any further. Similarly, since the adjustable stop trip dog 116B "flipped" the trip arm 118, the drive gear assembly 122 is oriented such that it engages the geared portion 120B of the bull gear 120 and attempts to rotate the bull gear 120 in a direction opposite the clockwise rotation of the user. In other words, the bull gear 120 is effectively maintained in place by the direction of rotation of the drive gear assembly 122, while the nozzle base 104 and clutch member 126 rotate relative to the trip dogs 116B, 120A.

Despite the fixed positions of both the bull gear 120 and adjustable stop member 116, the user can further rotate the nozzle base 104 in a clockwise direction since that rotation overcomes the force of the fingers 126A of the clutch member 126. Hence, in the clockwise rotational direction, the clutch member 126 allows the nozzle base 104 to rotate past the trip stop, changing the relative position of the nozzle 105 to the bull gear 120 and adjustable stop member 116. Since the adjustment shaft 112 rotates with the nozzle base 104, it further rotates within the nozzle base 104 to account for its movement around adjustment gear 114.

As previously described with regard to FIGS. 2A and 2B, the watering arc 102 can be angularly increased in size by a user grasping the nozzle base 104 and rotating it in a second direction (e.g., a counter clockwise direction). This functionality occurs by allowing rotation of the nozzle base 104 to rotate the adjustable stop member 116, but not the bull gear 120.

Specifically, as the nozzle base 104 is rotated in a counter clockwise direction, the adjustable stop member 116 is also rotated with the nozzle base 104. This movement occurs since the adjustment shaft 112 and the arc adjustment gear 114 engage the adjustable stop member 116. The arc adjustment shaft 112 is frictionally engaged with the nozzle base 104 via an o-ring 111 (FIG. 6) located between the shaft 112 and a shaft passage 104C (FIG. 17) in the nozzle base 104. Hence, this o-ring 111 acts as a clutch member and the frictional engagement it provides requires more force to overcome its engagement than can be provide via the above mentioned movements, thereby keying or synchronizing the movement of the adjustable stop member 116 to the nozzle base 104.

As the nozzle base 104 is rotated or "fast forwarded" through the watering arc 102, the bull gear trip dog 120A contacts and "flips" the trip arm 118, thereby reversing the direction of rotation that the drive gear assembly 122 exerts on the bull gear 120. In this respect, the drive gear assembly 122 maintains the rotational position of the bull gear 120. Since the bull gear 120 is maintained in place, further counter clockwise rotation of the nozzle base 104 results in enough force to overcome the engagement of the clutch member 126 with the geared region 120B of the bull gear 120. Hence, the adjustable stop trip dog 116B moves away from the bull gear trip dog 120A, increasing the watering arc 102.

As previously described with regard to FIGS. 3A and 3B, the watering arc 102 can be decreased in angular size by a user grasping the nozzle base 104 and "fast forwarding" it in a counter clockwise direction until prior to the trip stop (e.g., preferably by the angular amount that a user would like to decrease the watering arc 102), then reversing the direction of rotation of the nozzle base 104. This movement causes the adjustable stop trip dog 116B to move closer to the bull gear trip dog 120A.

Specifically, the user initially rotates the nozzle base 104 in the same direction that the gear assembly 122 attempts to rotate the bull gear 120 (i.e., "fast forwarding"), and therefore the clutch member 126 maintains its engagement with the bull gear 120. Since the user then reverses the direction of rotation of the nozzle base 104 without tripping the trip arm 118, the reversed rotational direction is opposite of the direction that the gear assembly 122 is rotating the bull gear 120. Hence, the clutch member 126 disengages with the bull gear 120 and the adjustable trip stop member 116 is rotated towards the trip arm 118, thereby reducing the size of the watering arc 102.

In this respect, the user can adjust the watering arc 102 by rotating the nozzle base 104 and without the need for an adjustment tool.

While the embodiment in these figures has been described such that rotating the nozzle base 104 in a clockwise or counter clockwise direction performs a certain adjustment action, it should be understood that the sprinkler 100 could also be configured to perform the same adjustment functions when turned in opposite directions. In other words, the sprinkler 100 can be configured to perform its arc adjustment functions in either direction.

The terms arc stop, trip stop, and similar terms are used in this specification and designate one of two locations in which the nozzle base 104 changes rotational direction. In this regard, the arc or trip stop locations are determined by the position of the adjustable stop trip dog 116B and the bull gear trip dog 120A within the sprinkler 100.

While the hand-adjustments of the present sprinkler 100 can be performed while the sprinkler 100 is in operation (i.e., spraying water), it should also be understood that they can be performed while water to the sprinkler 100 is turned off (i.e., dry).

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A sprinkler, comprising:

a sprinkler body;

a nozzle base disposed at a top of said sprinkler body;

a gear drive assembly driving rotation of said nozzle base relative to said sprinkler body;

a trip assembly connected to said gear drive assembly and having a trip arm switch selectively reversing a direction that said gear drive assembly rotates said nozzle base;

a bull gear having a first trip dog member extending away from said bull gear and rotationally aligned to contact said trip arm switch;

a first clutch member connected to said nozzle base and releasably engaged with said bull gear; and, an adjustable stop member having a second trip dog member that is rotationally aligned to contact said trip arm switch; said adjustable stop member being releasably engaged with said nozzle base via a second clutch member.

2. The sprinkler of claim 1, wherein said bull gear has a cylindrical shape with a plurality of gear teeth along an inner surface.

3. The sprinkler of claim 2, wherein said first clutch member is position within said bull gear.

4. The sprinkler of claim 3, wherein said first clutch has a plurality of radially extending fingers that are releasably engaged with said plurality of gear teeth of said bull gear.

5. The sprinkler of claim 4, further comprising an arc adjustment shaft engaged with said adjustable stop member.

6. The sprinkler of claim 5, wherein said second clutch member is an o-ring disposed on said arc adjustment shaft and releasably engaged with said nozzle base.

7. The sprinkler of claim 1, wherein user-rotation of said nozzle base in a first direction rotates a direction of a watering arc of said sprinkler and wherein user-rotation of said nozzle base in a second direction increases a size of said watering arc.

8. The sprinkler of claim 7, wherein fast-forwarding rotation of said nozzle base in said first direction, then user-rotating said outer nozzle base housing in said second direction decreases a size of said watering arc.

9. A sprinkler, comprising:

a sprinkler body;

a nozzle base disposed at a top of said sprinkler body;

a gear drive assembly driving rotation of said nozzle base relative to said sprinkler body;

a trip assembly connected to said gear drive assembly and having a trip arm switch selectively reversing a direction that said gear drive assembly rotates said nozzle base;

a first trip member positioned to periodically contact said trip arm switch during operation of said sprinkler; said first trip member being connected to said nozzle base via a first clutch; and, a second trip member positioned to periodically contact said trip arm switch during operation of said sprinkler; said second trip arm member being connected to said nozzle base via a second clutch.

10. The sprinkler of claim 9, wherein said first clutch comprises a cylindrical gear having an inner surface and a plurality of gear teeth disposed on said inner surface.

11. The sprinkler of claim 10, wherein said second clutch comprises an O-ring located on an arc adjustment shaft and frictionally engaging said nozzle base; said arc adjustment shaft being engaged with said second trip member so to cause rotation thereof.

12. The sprinkler of claim 9, wherein user-rotation of said nozzle base in a first direction rotates a direction of a watering arc of said sprinkler and wherein user-rotation of said nozzle base in a second direction increases a size of said watering arc.

13. The sprinkler of claim 12, wherein fast-forwarding rotation of said nozzle base in said first direction, then user-rotating said outer nozzle base housing in said second direction decreases a size of said watering arc.

14. A sprinkler, comprising:

a sprinkler body;

a nozzle base disposed at a top of said sprinkler body;

a gear drive assembly driving rotation of said nozzle base relative to said sprinkler body;

a trip assembly connected to said gear drive assembly and having a trip arm switch selectively reversing a direction that said gear drive assembly rotates said nozzle base;

a first trip member positioned to periodically contact said trip arm switch during operation of said sprinkler; said first trip member being connected to said nozzle base via a first clutch; and, a second trip member positioned to periodically contact said trip arm switch during operation of said sprinkler; said second trip arm member being connected to an arc adjustment shaft exposed on said nozzle base; and wherein said arch adjustment shaft is releasably connected to said nozzle base via a second clutch.

15. The sprinkler of claim 14, wherein user-rotation of said nozzle base in a first direction rotates a direction of a watering arc of said sprinkler and wherein user-rotation of said nozzle base in a second direction increases a size of said watering arc.

16. The sprinkler of claim 15, wherein fast-forwarding rotation of said nozzle base in said first direction, then user-rotating said outer nozzle base housing in said second direction decreases a size of said watering arc.

* * * * *